United States Patent [19]

Bregi

[11] 4,188,210

[45] Feb. 12, 1980

[54] IRON AND/OR STEEL TREATMENT WITH MAGNESIUM AND REFRACTORY COATED COMPOSITE SHOT

[75] Inventor: James F. Bregi, Plymouth, Mich.

[73] Assignee: Ford Motor Company, Dearborn, Mich.

[21] Appl. No.: 875,273

[22] Filed: Feb. 6, 1978

[51] Int. Cl.[2] ..... C22C 33/08

[52] U.S. Cl. ..... 75/130 R; 75/130 A; 75/130 AB; 75/130 B

[58] Field of Search ..... 75/130 R, 130 A, 130 AB, 75/130 B

[56] References Cited

U.S. PATENT DOCUMENTS 3,833,361 9/1974 Kusaki ..... 75/130 B

*Primary Examiner*—P. D. Rosenberg

*Attorney, Agent, or Firm*—Joseph W. Malleck; Olin B. Johnson

[57] ABSTRACT

A method of treating molten iron is disclosed. Iron shot controlled in particle size (0.04–0.20 inches) is coated with substantially pure magnesium (0.018–0.022 inches thick) and a wash coating of refractory (0.004–0.010 inches thick) is applied as an outer shell. The shot core serves to inhibit floatation of the magnesium treating agent and acts as a chill element controlling dissolution of the magnesium to improve efficiency and recovery. The weight ratio between the core and coatings can be conveniently varied to meet critical requirements for varying the metallurgical treatment.

6 Claims, No Drawings

IRON AND/OR STEEL TREATMENT WITH MAGNESIUM AND REFRACTORY COATED COMPOSITE SHOT

BACKGROUND OF THE INVENTION

It is generally accepted that it is most difficult to treat molten iron with magnesium so that it can be desulfurized or nodularized. This difficulty arises from a variety of physical characteristics which include (a) the typical treatment temperature for molten iron is usually at about 2600°–2800° F. and magnesium is in vapor form at that temperature level; (b) the solubility of magnesium into molten iron is extremely low; magnesium is a very light material and due to its low density tends to float on the molten metal and become oxidized; (d) magnesium oxidizes extremely rapidly when it comes into contact with air; and (e) magnesium is extremely reactive with molten iron and produces considerable pyrotechnic display which may consist of bursts of iron particles resulting from such reactivity.

The prior art has attempted to carry out the magnesium reaction according to principally four methods: the sandwich method, the injection method, and plunging process, and the Fisher or Kuboto processes requiring a pressure type reaction chamber. The sandwich method involves diluting the magnesium by alloying with nickel or silicon so that when the diluted material is brought into contact with the molten iron, which is preferably laid on the bottom of the molten vessel, a reduced magnesium vapor pressure will result and thus retard the tendency to send off magnesium vapors with extreme reactivity. Examples of magnesium alloys include Mg-Ni and Mg-Fe-Si. Unfortunately, these alloys are either expensive or insufficiently heavy so that additional steel cover of particles is necessary to prevent them from floating upwardly in the reaction ladle. The principal difficulty with the sandwich method is that the recovery of magnesium is low at about 30–50% of the magnesium that is added to the process. (Recovery shall mean herein the ratio between the units of a material added to a process and the units of the material appearing in the final metal product plus that combined with impurities).

Although not commercially used, the injection of magnesium powder takes place by the use of an inert vehicle such as nitrogen gas. It is typical for such magnesium powder to carry an oxide coating thereon by the mere nature of the production of the magnesium particles. The recovery of magnesium in the final metal is low (30% recoveries are typical), due to the floating of the powder inhibiting proper reaction and to dilution resulting from the formed oxides.

The plunging process uses a block of pure magnesium coated with layers of suitable refractory or employs a coke body impregnated with pure or high magnesium, each of which are plunged (carried mechanically) into the molten bath of iron. If carried out in a conventional way with the plunging tool introduced from the top of the open ladle and carried close to the bottom of the vessel, the recovery of magnesium will be 30–40%. The plunging process and Fisher or Kuboto processes are disadvantageous because a large mass of magnesium is allowed to react uncontrollably and special apparatus is required to obtain or contain access to the molten metal.

What is needed is a method which permits simple predetermined adjustment of the magnesium additive to achieve a more controlled reaction with molten metal without the need for special or expensive apparatus. The method should employ hydrostatic pressure of the molten metal to contain any magnesium vapor rendering a higher efficiency in graphitizing or desulfurizing of the metal. It is also important to carry out such reaction without diluting the magnesium which affects efficiency of magnesium recovery.

SUMMARY OF THE INVENTION

A primary object of this invention is to provide an improved method for treating molten iron in an open ladle to achieve more convenient and efficient desulfurization and/or nodularization.

Yet another object of this invention is to provide a method of treating molten iron for desulfurization and/or nodularization in the ladle without the necessity for independent or special apparatus and which allows simple adjustment of the proportion of magnesium employed to match varying process conditions for increasing recovery.

A specific object is to provide a material for treating molten iron which inhibits floatation of the treating agent and promotes a more controlled dissolution of the magnesium.

Specific features pursuant to the above objects comprise (a) the use of iron shot controlled as to size and coated with a system consisting of a moderately thin pure magnesium inner shell and an outer wash coat of refractory material; (b) controlling the weight ratio between the mass of magnesium contained in the shell coating and the core of solid iron, whereby the core will act as a chill for the magnesium during the transient period of dissolution promoting better dissolution control and act as a sufficient weight to insure the magnesium shell will be at or near the deep bottom zone of the molten metal during dissolution; and (c) it is preferable to add the shot to an open ladle prior to the filling with molten metal so that the refractory coating need be maintained as thin as possible; however, it is operable to utilize the shot of this invention by addition to the stream of metal being poured into the ladle or to the molten bath within the ladle previously poured.

DETAILED DESCRIPTION

The treating agent of this invention useful for desulfurization and/or nodularization of molten iron in an open ladle, can be prepared preferably by the following steps:

(a) Iron shot is formed by conventional techniques having a particle diameter equal to or less than 1/16th of an inch (corresponding to size 660–780 shot). The shot composition is preferably low carbon steel or alternatively grey iron. Steel shot (SAE 1010 or 1020) will have less carbon content compared to cast iron, which carbon content along with surface cleanliness affects the tendency of magnesium to coat the shot. In addition, steel desirably denses by about 10% compared to cast iron.

The weight ratio of the iron shot to the magnesium coating, to be applied thereover, can be proportioned by design for the metal treatment desired. For example, if the shot is to be used for an iron melt which is to be only desulfurized, the thin controlled shell of magnesium should have a weight calculated to react with all of the intended sulfur within the molten iron with little or no residual magnesium contained in the iron upon solidification. To increase the volume and therefore the weight of the magnesium in the coating, the shot can be reduced in size thereby increasing the total surface area of the composite collection of shot particles. This increased surface area, within a given charge volume of shot, is the control factor that can be varied to regulate the weight ratio between the magnesium and iron core. If the iron shot is to be employed for both desulfurization and nodularization as preferred herein, then the content of magnesium must not only be sufficient to react with substantially all of the sulfur in the molten metal but must provide for at least 0.03% residual magnesium content in the solid iron.

Shot diameter size must be in the range of 0.04–0.20 inches. It is preferable that the shot be sized as uniform spheroids to facilitate pouring and fluid handling of the shot charge during transfer of the shot to the molten metal. It is also important that the shot have a clean surface which may be obtained by dipping in an aqueous hydrocloric acid solution for a period of time, such as a few seconds.

(b) The cleaned and sized shot is then immersed in a tank filled with molten magnesium held typically at the temperature of about 1200°–1300° F. The shot is dredged through such molten metal and placed onto a controlled atmosphere heated hearth which provides a controlled temperature bed for allowing the coated shot to be separated along a planner surface prior to solidification of the molten magnesium. A rake is employed to separate the shot; the hearth temperature is progressively reduced to allow solidification of the coating. When the shot particles have sufficiently solidified, the shot is collected for transfer. The magnesium coating is a thin shell controlled to a thickness of 0.018–0.022 inches.

(c) The magnesium coated shot is transferred to an immersed in a ceramic slurry, for a period of time usually only a few seconds, so that the surface of such coated shot will receive only a wash of the refractory material (about 0.004–0.010 inches thick). This prepared product will have a predetermined uniform magnesium distribution about a given weight of iron and therefore the quantity of shot employed can be precisely selected for any given treatment requirement.

Utilizing this prepared shot, a preferred method of carrying out metal desulfurization and/or nodularization is as follows:

(a) An open ladle is employed which is first provided with a predetermined charge of the prepared shot, the shot being poured into the empty ladle so that it can reside in a small mound at the bottom thereof.

(b) Molten iron metal of a composition typically containing sulfur in the range of 0.04–0.120%, carbon in the range of 3.05–4.10%, and the usual amounts of residual elements. The molten iron is transferred into the molten ladle at a temperature of about 2550°–2650° F. The pouring of the molten metal is controlled so that the shot is not significantly displaced by pouring pressure. The molten metal is filled to a level within the ladle providing a hydrostatic head of no greater than 2–3 feet. Upon initial contact of the coated shot by the molten metal, the refractory wash will act as a temperature barrier for a temporary period of time (about 2–5 seconds) sufficient to allow the molten metal to be fully poured. This prohibits the violent reaction of pure magnesium with the molten metal upon instantaneous engagement thereby preventing the turbulent disruption of the molten metal accompanied by pyrotechnics and splashing.

With the wash coat of the refractory dissipated by the temperature of the molten metal, the pure magnesium coating will have been heated preferably to obtain only a degree of melting of the magnesium to a liquid at the temperature level of about 1200° F. It is typical with prior art methods, for the magensium to go immediately to a vapor by flashing (typically at a temperature level of about 1600°–1800° F.; this results from the rapid heating of the magnesium upon contact with the molten metal. This does not necessarily take place in conjunction with this invention, because the core of each of the shot elements acts as a chill element controlling the rate at which the magnesium is heated. The magnesium is allowed to go through a temporary stage at which it can become liquid without necessarily flashing to a vapor immediately. Liquid magnesium will dissolve into the molten metal much more readily than magnesium vapor and this leads to an increase in both the recovery of the magnesium as well as efficiency of the process.

What is claimed is:

1. A process for the production of cast iron castings comprising:

(a) introducing into a ladle a predetermined charge of molten iron having sulfur in the range of 0.04–0.12% by weight of such composition that it would be a grey cast iron with the graphite in flake form if case, the charge is of such quantity to provide a ferrostatic head of at least two feet;

(b) either prior to or simultaneous with step (a), pouring a charge of coated iron-based shot onto the bottom of said ladle, each particle of said shot having a diameter substantially in the range of 0.4–0.20 inches, each particle of shot having an inner coating of substantially pure magnesium and an outer coating of a refractory material resistant to melting at molten iron temperatures, said magnesium coating forming a thin shell about each of said particles with a uniform thickness of 0.018–0.22 inches, said outer coating consisting of a wash in the thickness range of 0.004–0.010 inches, said iron based shot being added in a quantity predetermined to carry sufficient magnesium for at least desulfurizing said molten iron and acting as a chill core to promote liquidification of said magnesium coating by the heat of said molten iron.

2. The process as in claim 1, in which said shot is comprised of a low carbon steel, which shot is cleansed in an acid solution prior to being coated with magnesium.

3. The process as in claim 1, in which said iron based shot is comprised of cast iron of the same general composition as that of the molten iron except that the carbon is limited to less than 3.5%, the shot being cleansed in an acid solution prior to being coated with magnesium.

4. The process as in claim 1, in which the weight ratio of magnesium to iron for each shot particle is controlled to be in the range of 0.1–0.2.

5. The process as in claim 1 which is adapted to nodularization of said molten iron, the diameter size of each of said particles being in the range of 0.04–0.10 inches, the shell of magnesium about each of said particles being proportioned to provide a higher content of magnesium with respect to the iron in any given cubic foot of charge of shot sufficient to render a residual magnesium content in the solidified casting of at least 0.03%, said shot diameter and corresponding shot weight being sufficient to act as a chill for increasing the dissolution of magnesium into the molten iron and to maintain the particles weighted to the bottom of said ladle during magnesium dissolution.

6. The process as in claim 1, which is adapted to desulfurization of said molten cast iron, the size of each of said shot particles is limited to a diameter of 0.08–0.20 inches thereby limiting said magnesium content with respect to the iron in any given cubic foot of charge of shot sufficient to only desulfurize said charge of molten cast iron while increasing the chill for controlling the dissolution of magnesium.

* * * * *